US006913369B2

(12) United States Patent
Chadwick

(10) Patent No.: US 6,913,369 B2
(45) Date of Patent: Jul. 5, 2005

(54) WALL OR CEILING MOUNTABLE DEVICE AND WALL STRUCTURE INCORPORATING DEVICE

(76) Inventor: Bernard L. Chadwick, 12461 Vaughan Rd., Poway, CA (US) 92064

( * ) Notice: Subject to any disclaimer, the term of this patent is extended or adjusted under 35 U.S.C. 154(b) by 0 days.

(21) Appl. No.: 10/200,376

(22) Filed: Jul. 19, 2002

(65) Prior Publication Data

US 2003/0029981 A1 Feb. 13, 2003

Related U.S. Application Data

(63) Continuation-in-part of application No. 09/814,676, filed on Mar. 21, 2001, now abandoned.

(51) Int. Cl.[7] ..... F21S 8/00
(52) U.S. Cl. ..... 362/147; 362/806; 362/151
(58) Field of Search ..... 362/147, 247, 362/307, 347, 806, 151; 4/300.1, 901; 248/231.9, 222.11, 223.41, 225.11, 343, 344; 52/27, 34

(56) References Cited

U.S. PATENT DOCUMENTS

| | | | | |
|---|---|---|---|---|
| 1,775,768 A | | 9/1930 | Kenerson | |
| 1,908,586 A | | 5/1933 | D'Olier, Jr. | |
| 3,298,764 A | | 1/1967 | Goldfarb | |
| 3,780,281 A | * | 12/1973 | Ohlhauser et al. | 362/128 |
| 4,134,625 A | | 1/1979 | Palka | |
| 5,278,738 A | * | 1/1994 | Illes | 362/147 |
| 5,379,199 A | | 1/1995 | Hirshenhorn et al. | |
| 5,401,231 A | * | 3/1995 | Hebert | 492/37 |
| 5,405,196 A | | 4/1995 | Shoup | |
| D361,639 S | * | 8/1995 | Christopoulos | D26/85 |
| 5,440,854 A | | 8/1995 | Hohmann | |
| 5,484,196 A | | 1/1996 | Kim | |
| 5,755,070 A | | 5/1998 | Hohmann | |
| 5,826,973 A | * | 10/1998 | Melzian et al. | 362/297 |
| 5,974,753 A | | 11/1999 | Hsu | |
| D422,107 S | * | 3/2000 | Meier | D26/87 |
| 6,089,685 A | | 7/2000 | Ryan et al. | |
| 6,115,977 A | | 9/2000 | Hornberger | |
| 6,167,575 B1 | * | 1/2001 | Smith | 4/209 R |
| 6,612,076 B2 | * | 9/2003 | Jacksen | 52/27 |

OTHER PUBLICATIONS

HITW Series, Engineered Lighting Products, first published 1990.
HITC Series, Engineered Lighting Products, first published 1994.
GRG Architectural Lighting Fixtures, HITC and HITW Series, Engineered Lighting Products 2002 (HITC Series first available 1994, HITW Series first available 1990).

* cited by examiner

*Primary Examiner*—Sandra O'Shea
*Assistant Examiner*—Sharon Payne
(74) *Attorney, Agent, or Firm*—Gordon & Rees LLP

(57) ABSTRACT

A wall or ceiling mountable device has a body of predetermined shape for forming a wall or ceiling feature and a flat, peripheral flange of predetermined width projecting outwardly from the perimeter of the body. The body may be a light sconce or valance, niche, shelving unit, bas-relief, or other feature. The flange has a periphery of predetermined shape for mounting in a wall or ceiling opening of corresponding shape and dimensions with the outer face of the flange flush with the surrounding wall or ceiling surface, and the seam or joint between the flange and opening is finished such that the body appears to be molded integrally with the wall or ceiling.

22 Claims, 8 Drawing Sheets

WALL OR CEILING MOUNTABLE DEVICE AND WALL STRUCTURE INCORPORATING DEVICE

CROSS-REFERENCE TO RELATED APPLICATIONS

This application is a Continuation-In-Part of application Ser. No. 09/814,676 filed Mar. 21, 2001, now abandoned.

BACKGROUND OF THE INVENTION

The present invention relates generally to wall or ceiling mountable devices or custom recessed building products such as light sconces, light valances, pre-manufactured recessed niches, pre-manufactured wall shelves, light covers, receptacle plug covers, vent covers, and the like, and to wall or ceiling structures with such devices mounted therein.

A typical light sconce or other wall mountable device, regardless of its shape or design, is designed to have a flat back plate or panel so that it can be attached flat on top of the wall surface. The sconce is typically mounted with two screws to an electrical box that is mounted on the wood or metal wall studs behind the drywall. The back plate is on top of the drywall, projecting out from the wall in an unattractive manner, and leaving a cold joint or gaps at the point of connection to the wall. Additionally, wall mountable devices such as recessed niches, shelving, light sconces and valances have in the past mainly been custom made by hand, one at a time, by skilled craftsmen. Manufacture of such devices by hand, one at a time, makes them relatively expensive, and also gives rise to inconsistency in shape from one device to another, which is a problem where several are to be installed in one room or area.

SUMMARY OF THE INVENTION

It is an object of the present invention to provide a new and improved wall or ceiling mountable device and wall structure incorporating such a device in a wall.

According to one aspect of the present invention, a wall or ceiling mountable device is provided, which comprises a body of predetermined shape for forming a wall or ceiling feature or fixture, the body having a perimeter and a peripheral flange projecting outwardly from the perimeter of the body and offset from the body, the flange having periphery of predetermined shape for mounting in a wall or ceiling opening of corresponding shape and dimensions, such that the body can be recessed into the wall with the flange flush with the surrounding wall, whereby the body appears to be molded integrally with the wall, the device being formed integrally of a non-metallic material which will adhere to mud and plaster applied over the outer surface of the device.

In one exemplary embodiment of the invention, the wall mountable device comprises a light sconce of generally bowl-like shape having a recess with an upwardly facing opening in which a light fitting can be recessed. The flat, peripheral flange surrounds the light sconce and is molded integrally with the sconce to form a continuation of rear wall of the sconce. An electrical junction box may be installed into the back of the molded device behind the recess. Alternatively, the device may be a recessed mounting panel for a wall socket cover plate, access panel, vent cover, switch plate or the like. The mounting panel has a central opening with a recessed peripheral rim surrounded by the peripheral flange. With this arrangement, cover plates, vent covers, and the like can be mounted in the recess flush with the wall, rather than projecting outwardly as in the conventional arrangement. Other wall mountable devices which may be formed with a peripheral flange for flush or recessed wall mounting include, shelving units, niches and the like. The wall feature need not necessarily be recessed, and may comprise a decorative feature such as a bas relief, statue or the like. The device may be designed for mounting in an opening in a flat wall or ceiling surface, or may be designed to mount in an inside or outside corner, or on a wall end. With this invention, such features will appear to be integrally formed with the wall or ceiling itself, creating a smooth and attractive appearance.

The perimeter seam or joint between the flange and edge of the wall or ceiling opening may be covered by tape or the like, and the device and adjacent wall may then be coated with drywall mud or the like, then textured and painted, so that the wall mounted device or feature appears to be formed integrally with the wall. This will permit various different types of wall or ceiling mountable features or devices such as recessed lighting devices or sconces, recessed mounting panels for switch or socket plates, vent covers, and shelving units, niches or the like, to be mounted with their peripheral flanges flush in a wall opening, producing a much more decorative and pleasing effect.

The dimensions of the peripheral flange around the perimeter of the wall feature, such as a lighting sconce, must be sufficient for receiving a strip of drywall tape for covering the junction between the flange and wall opening. In practice, the peripheral flange width may be at least two inches around the entire border of the protruding wall feature.

According to another aspect of the present invention, a wall structure is provided, which comprises a wall portion having an opening of predetermined shape and dimensions, at least one wall stud behind the opening, a wall mountable device having a body of predetermined shape for forming a wall feature, the body having a perimeter, and a flange projecting outwardly from the perimeter of the body so as to completely surround the body, the flange having a periphery of shape and dimensions matching those of the wall opening, the wall mountable device being mounted in the wall opening with the periphery of the flange abutting the periphery of the opening to form a dividing seam between the wall mountable device and wall portion, the flange having an outer surface which is substantially flush with the outer surface of the adjacent regions of the wall portion, the flange being secured to the wall stud, drywall tape applied on top of the dividing seam to cover the seam, and a coating material applied over the wall mountable device, adjacent wall portion and the tape. The term "wall" is intended to also cover situations where a feature or fixture is incorporated into a ceiling structure, for example a ceiling light structure.

The coating material will be a conventional drywall mud or plaster, and paint or texture may be applied over the coating material such that the wall mountable device appears to be an integral part of the surrounding wall, and there are no projecting edges, gaps, or cold joints. Where the size of the feature or wall mountable device is such that it spans two wall studs, the flange will be secured to both wall studs via countersunk screws or the like, which are also subsequently covered by the coating material.

The wall structure may comprise a flat wall or ceiling, or may comprise a corner or end of a wall. In the case of a corner, the opening will span the corner and the wall mountable device has perpendicular flanges for mounting in the perpendicular portions of the wall opening. In the case of an end of a wall, such as a dividing wall or the like, having an end portion and perpendicular opposite wall portions extending from the end wall portion, an opening is cut into the wall end, and the flange has an end portion and perpendicular wall portions extending from the end portion, for fitting into the corresponding portions of the opening.

The wall mountable device and wall structure incorporating the device has advantages over the prior art, where wall features and fixtures were typically custom made and secured on top of the wall surface. First, once mounted and finished, the device will appear to be an integral part of the wall itself, which is much more attractive. Second, installation of the device will be much faster and more economical than for a custom-made wall feature. A large variety of such wall mountable devices can be used at appropriate locations in a building, such as lighting sconces, switch panels and socket plates, vent covers, shelf units, decorative features such as statues, other lighting fixtures, recessed picture framing, and the like, making the entire wall of a building appear to have been integrally constructed without any untidy edges, screws or the like appearing on the visible surface of the wall.

BRIEF DESCRIPTION OF THE DRAWINGS

The present invention will be better understood from the following detailed description of some exemplary embodiments of the invention, taken in conjunction with the accompanying drawings in which like reference numerals refer to like parts and in which:

FIG. 17 is a sectional view of a panel with a recess instead of a sconce, the mounting being similar;

DETAILED DESCRIPTION OF THE DRAWINGS

Figure 1:
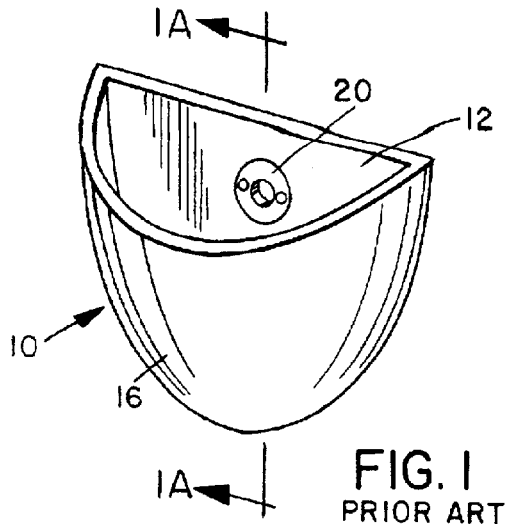
FIG. 1 PRIOR ART
FIG. 1 is a perspective view of a typical prior art sconce.
Figure 1A:
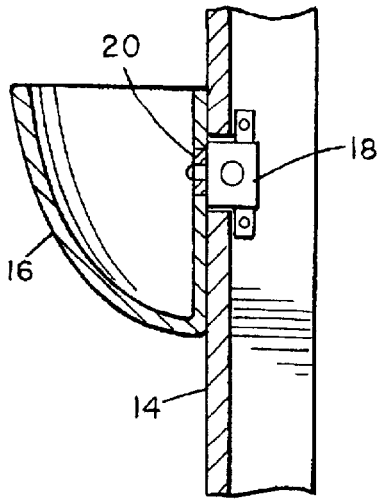
FIG. 1A PRIOR ART
FIG. 1A is a sectional view taken on line 1A—1A of FIG. 1 showing the sconce mounted on a wall with an electrical outlet box.

FIGS. 1 and 1A illustrate a typical prior art light sconce 10 with a rear wall 12 adapted to be attached flat on top of a wall surface 14. The sconce 10 has an outwardly projecting, bowl-like form 16 with an upwardly directed opening. The sconce 10 is mounted with two screws to an electrical box 18 behind the wall which is secured to existing wood or metal wall studs. A light socket 20 is provided on the flat rear wall 12 for mounting a light bulb within the recessed region of the bowl, to produce a desired upwardly directed lighting effect. Prior art light valances are mounted in a similar manner.

The prior art installation method for such wall mounted features as light sconces and valances results in a cold joint or gaps at the point of connection to the wall, as well as an unattractive appearance with the rear wall of the feature projecting out from the wall. Additionally, features such as recessed niches, shelving, light sconces and valances are, for the most part, hand made one at a time by skilled craftsmen. A niche in drywall, for example, will be framed to a specific size and shape. Drywall will then be applied over the recessed frame to form the finished shape. Corner bead material is then installed, and the corner bead and all joints will be taped, floated, and then textured and painted to complete the feature. Other wall features are made in a similar manner, and are typically applied on top of the existing wall surface, so that they project out and do not integrate smoothly with the wall.

Figure 2:
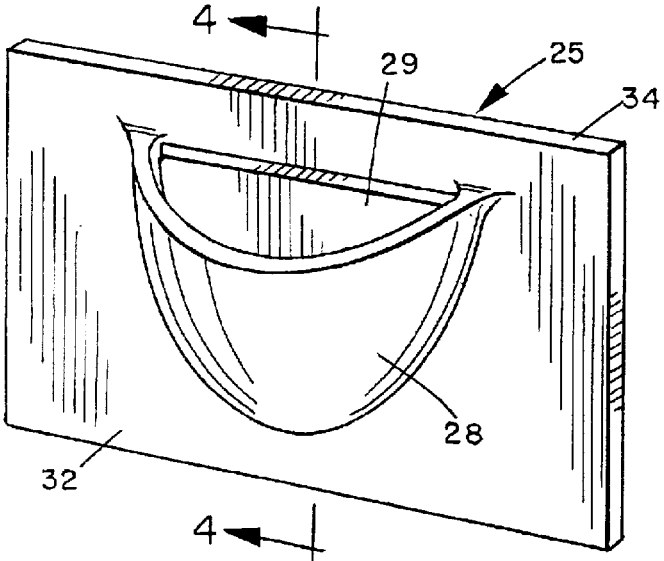
FIG. 2 is a perspective view of the new sconce with an integral mounting panel, according to one embodiment of the invention.

FIG. 2 of the drawings illustrates a light sconce panel 25 according to an exemplary embodiment of the present invention. The panel 25 is suitably formed of drywall type material such as Hydrocal™, which is a white gypsum cement available from U.S. Gypsum, or other non-metallic, moldable material to which drywall plaster can be applied. The panel has a flat rear wall of generally rectangular shape with an integrally formed, protruding bowl or sconce 28 having a recess 29 with an upwardly facing opening 30. The wall dimensions are such that a peripheral flange 32 extends around the entire perimeter of the bowl. The dimensions are such that the flange 32 projects for at least two inches around the entire perimeter of the bowl 28, and the outer periphery 34 of the panel is of rectangular shape. Other perimeter shapes such as square or round may be used, but a square or rectangular panel shape will allow easier wall mounting than other shapes. The outer dimensions of the panel will be dependent on the dimensions and peripheral shape of the feature incorporated in the panel. It will be understood that FIG. 2 illustrates one possible sconce or bowl shape, and that other shapes and dimensions may be used in other examples, with suitably adjustment of the panel dimensions to provide for the two inch surrounding flange. Additionally, panels may be provided with other wall features, such as downwardly facing light valances, niches or the like as described in more detail below.

Figure 4:
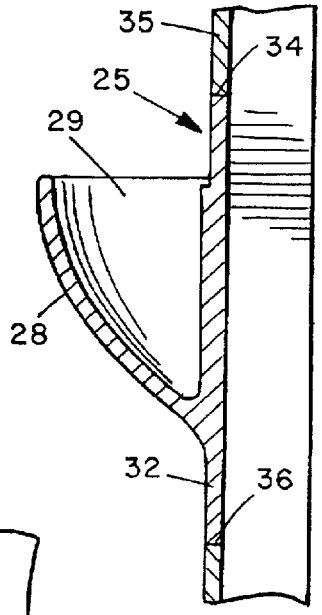
FIG. 4 is a sectional view taken on line 4—4 of FIG. 2 showing the panel mounted flush in drywall.
Figure 3:
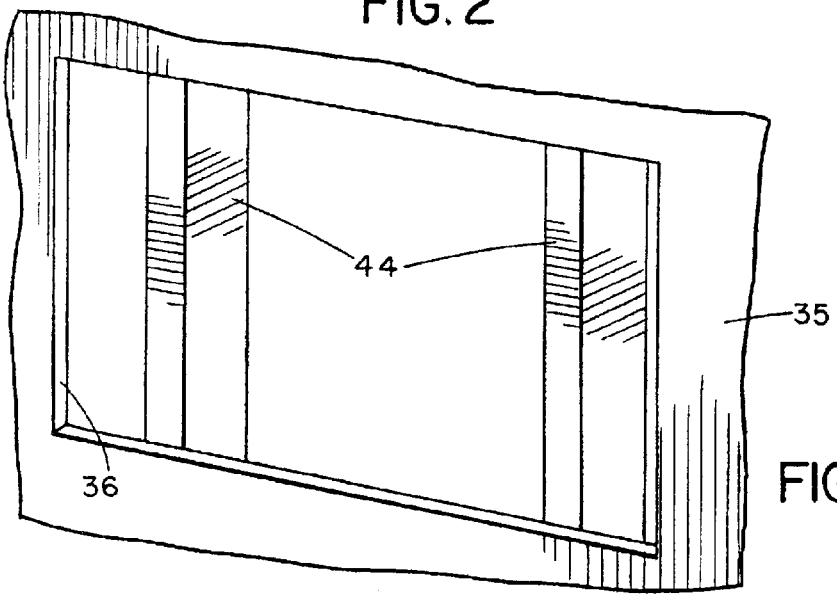
FIG. 3 shows a cut out made in drywall to receive the panel.
Figure 16:
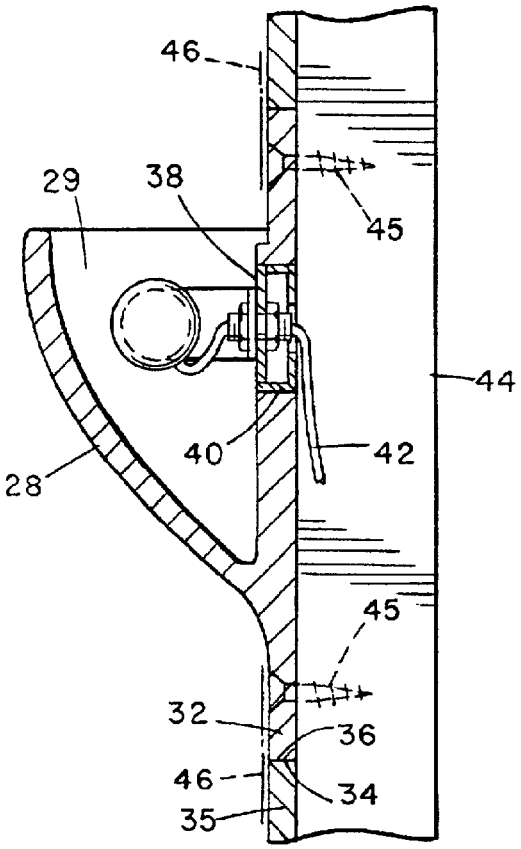
FIG. 16 is an enlarged view similar to FIG. 4 showing the installation of the panel with an electrical fitting for a light fixture.

A method of mounting a panel 25 in a wall 35 will now be described with reference to FIGS. 3, 4 and 16. First, panel 25 is held up to the wall at the position it is to be mounted, and a level is placed on the top edge of the panel. Once the panel is leveled, the periphery of the panel is marked with a pencil. Next, the wallboard is cut out along the pencil line with a rotary cutting tool or the like, leaving a rectangular opening 36 of dimensions matching those of the panel 25, as illustrated in FIG. 3. Any necessary electrical wiring is run to the wall cut out. Prior to mounting the panel in the wall opening, an electrical box 38 for a light fixture is installed in the rear wall of bowl 28, as illustrated in FIG. 16. Box 38 is mounted in an opening 40 cut in the panel, and may be secured in place by adhesive if necessary, or may simply be press-fit in the opening. Wiring 42 is then run into the electrical box at the back of the feature, and the panel 25 is positioned in the wall opening. The light fixture 43 is mounted to the box after the unit is completely installed and finished.

Prior to securing the panel 25 in the opening, the positions of studs 44 are suitably marked on the wall. If no stud is present, mounting clips may be positioned on the ends of the panel for securing the panel in the wall opening. If studs are present, countersunk holes are drilled at the top, bottom and sides of the flange 32 where the studs are marked, and drywall screws 45 are placed in each of the countersunk holes to secure the panel to the studs 44, as indicated in FIG. 16.

Once the panel has been mounted flush in the wall opening, as indicated in FIGS. 3 and 16, standard drywall mesh tape 46 is applied around all four perimeter seams, as indicated in dotted outline in FIG. 16. Two to three successive coats of drywall mud are then applied over the panel and adjacent wall surfaces. When the seams are totally hidden, the surface is sanded to a smooth texture. Texture may then be applied to the entire feature, panel and sconce, to match the surrounding wall, and the feature may then be painted with the same paint as the surrounding walls.

It can be seen that the panel thickness is substantially the same as that of the surrounding wallboard, and that, once mounted and finished, the outer face of the flange 32 will be completely flush with the surrounding wall surface. Thus, the sconce appears to have been formed integrally with the wall itself, rather than being a completely separate feature, and there are no projecting edges, gaps, or cold joints. The panel is of sufficient width to span the gap between two wall studs 44, so that it can be securely fastened to two underlying studs.

Figure 5:
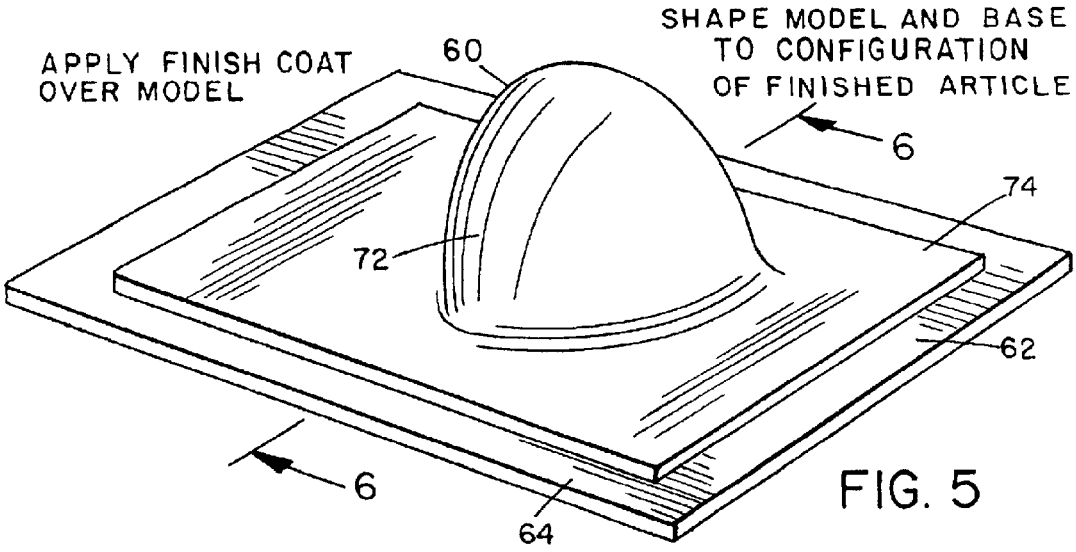
FIG. 5 is a perspective view of a mold of the sconce and panel mounted on a work platform.
Figure 6:
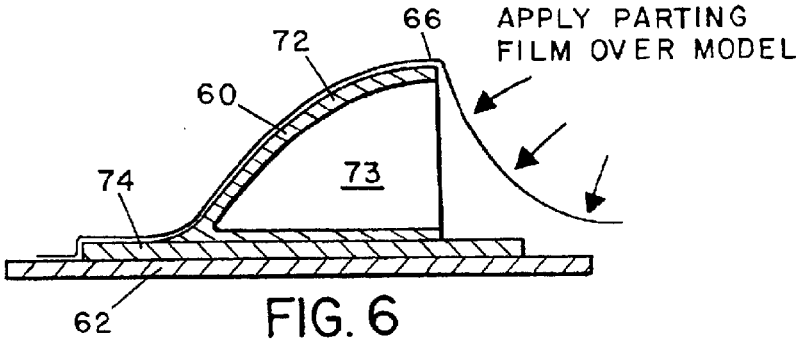
FIG. 6 is a sectional view taken on line 6—6 of FIG. 5 showing the initial preparation step.

FIGS. 5 to 15 illustrate an exemplary method of making a panel and integral wall feature, such as a light sconce as illustrated in FIG. 2, according to another aspect of the invention. The first step in the method is making a model or mold 60 out of clay in the desired shape of the finished product, as illustrated in FIGS. 5 and 6. The mold 60 in the illustrated method is of the same shape as sconce panel 25 of FIG. 2, with a bowl shape 72 forming a cavity 73 and a peripheral flange 74 surrounding the bowl. The mold or model 60 is formed on a base sheet 62 of wood or the like, with the sheet having a rectangular shape matching that of the finished article but around 1 to 2 inches larger on all sides, such that a peripheral edge portion 64 of the base sheet projects from the perimeter of the model 60 on all sides. The clay is then shaped on top of the base sheet to the configuration of the finished article. Once the model is complete, several layers of finish coat such as lacquer are sprayed on top the seal the model.

Figure 7:
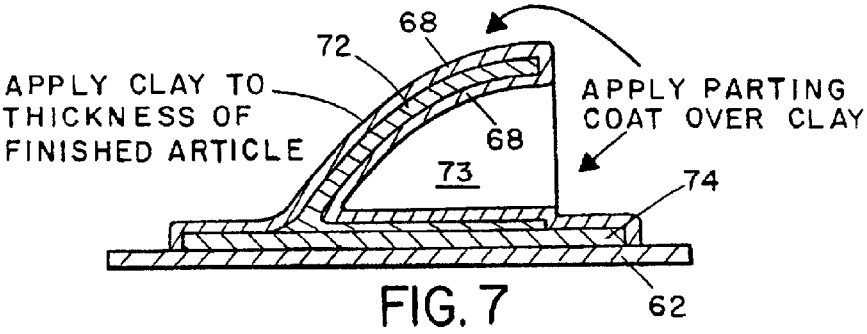
FIGS. 7–12 are similar sectional views showing the sequential steps in preparing the shaped liner for casting the product.

The entire model or mold 60 is then covered with a parting film 66 of cellophane or the like, as indicated in FIG. 6. After applying the parting film, a layer 68 of clay is rolled out to the desired thickness of the finished product, and then applied on top of the mold 60, as indicated in FIG. 7. A rim or dam 70 of clay is then formed at the top of the bowl 72, as indicated in FIG. 8, and a parting coat is applied over the clay.

Figure 8:
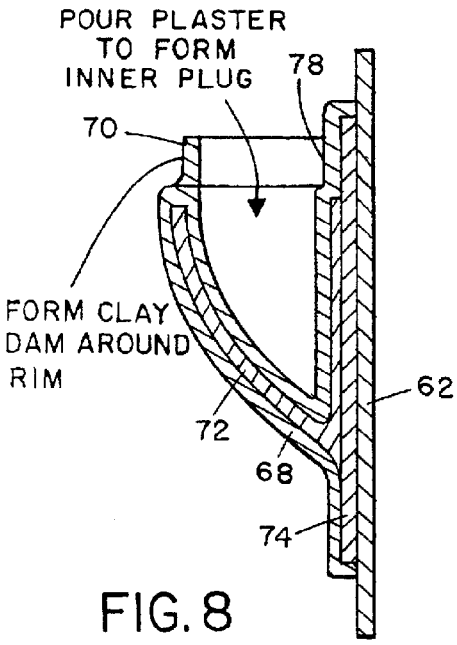
Figure 9:
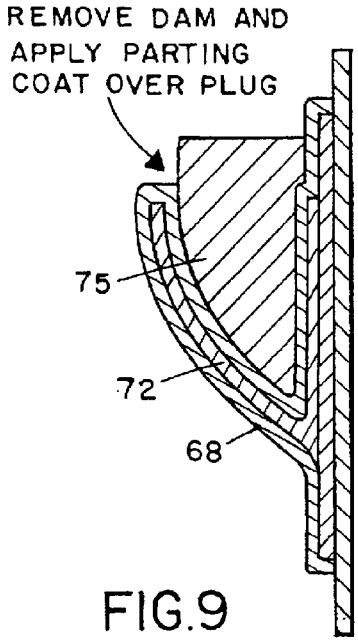

Plaster is then poured into the bowl 72 to form an inner plug 75, as indicated in FIGS. 8 and 9. The plaster is of any suitable material such as Hydrocal™ or the like. The dam 70 allows the plug shape to project around two inches beyond the rim of bowl 72. After the plug 75 is poured and set, the dam 70 is removed. Next, the portion of the plug 75 which projects out of the top of the bowl is painted with a suitable coating material such as shellac, and a thin layer of parting material such as Vaseline® or other lubricant is used to coat the exposed portion of the plug.

Figure 10:
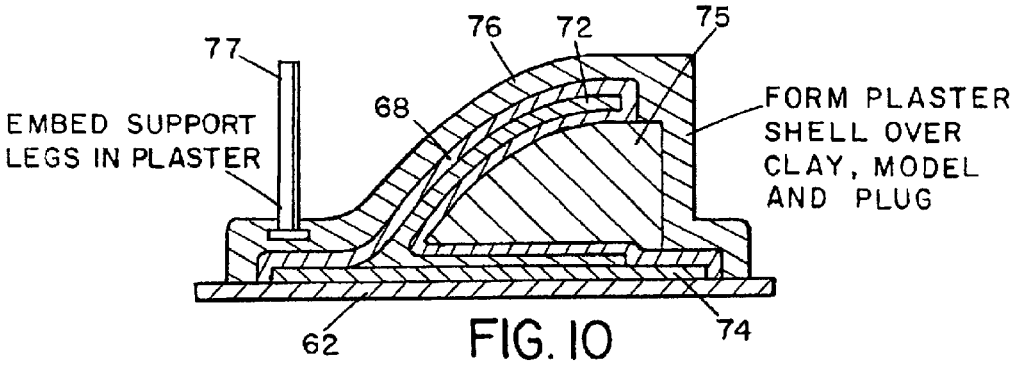
Figure 11:
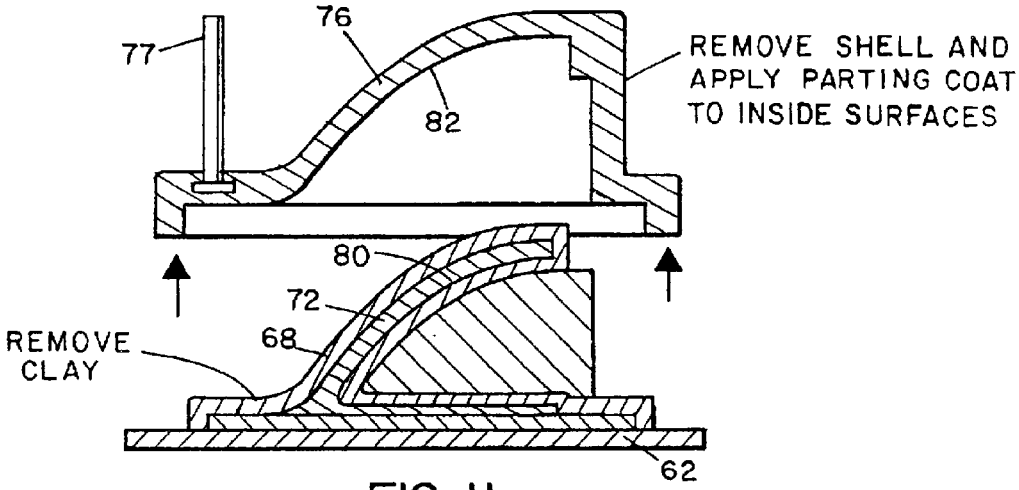

The next step of the method is illustrated in FIG. 10. In this step, a mixture of clay such as white gypsum cement and water is poured over the model 60 and exposed portion of the plug 75. Layers of clay mixture and fiberglass mesh are applied over the model until an outer shell 76 of predetermined thickness is formed. In an exemplary embodiment, the shell 76 had a thickness of at least 0.5 inches. Support legs 77 are embedded in the plaster before it hardens. Once the outer shell 76 has hardened, it is removed carefully from the model, as indicated in FIG. 11. The parting material coating the model and exposed portion of the plug will ensure that the clay shell material does not stick to the model or plug as it is lifted away from the model. The inner clay layer 68 is then removed from the model 60, after first taking out the plug 75. The plug is then replaced, seating in a suitable groove or the like provided in the lower wall 78 of the mold or model, or alternatively secured in place with bolts or the like, so as to leave a gap of predetermined thickness between the outer surface of the plug and the inner surface of the bowl where the clay layer 68 was removed.

Figure 12:
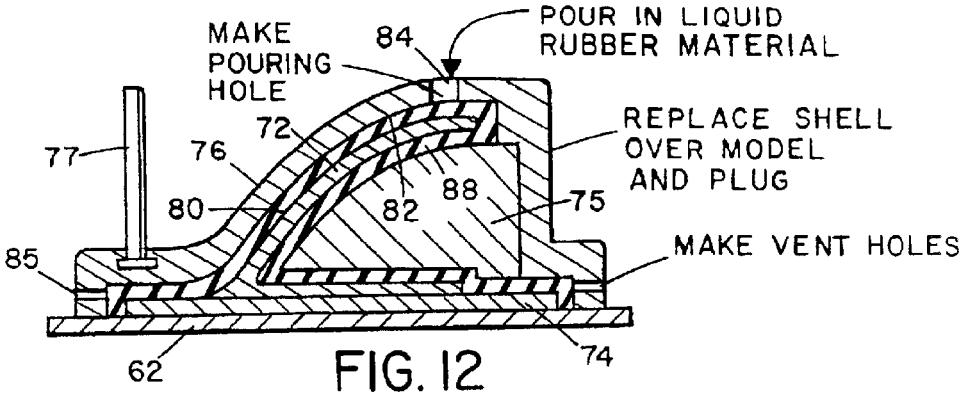
Figure 13:
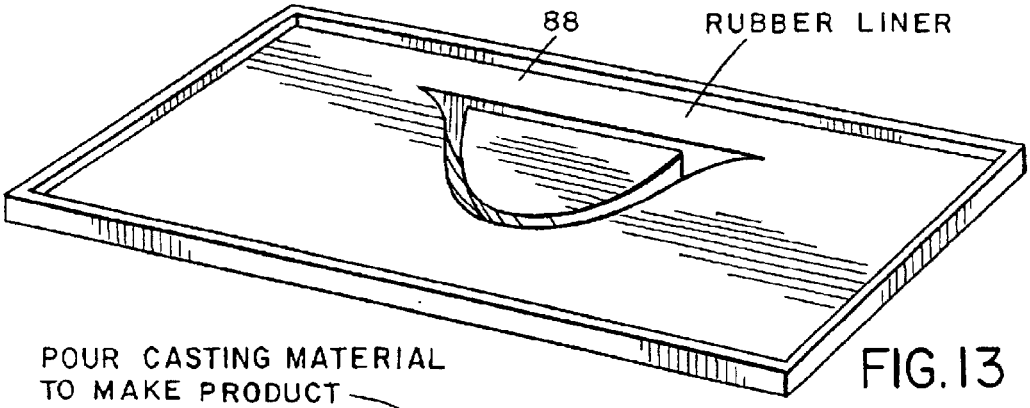
FIG. 13 is a perspective view of the rubber liner.

Several coats of sealer material such as shellac are then applied to the inner surface of the shell 76. The shell is then placed back over the model 60 and plug 75, leaving a gap between the outer surface 80 of the model and the inner surface 82 of the shell 76, equal in thickness to the thickness of the removed clay layer 68. A pour hole 84 is then formed in the top of the shell 76. Vent holes 85 will also be provided around the edges of the shell. Liquid rubber 86 is then poured in through hole 84, as indicated in FIG. 12, and will fill the gap between the shell and model and between the plug and the inner surfaces of the model. When rubber starts to flow out of the vent holes 85, the holes are plugged and the rubber is allowed to cure for 16 to 24 hours. The outer shell is then lifted off, and the plug is removed. The rubber liner 88 is then peeled off the model, and will have the shape illustrated in FIG. 13, which is a negative of the desired product shape illustrated in FIG. 2.

Figure 14:
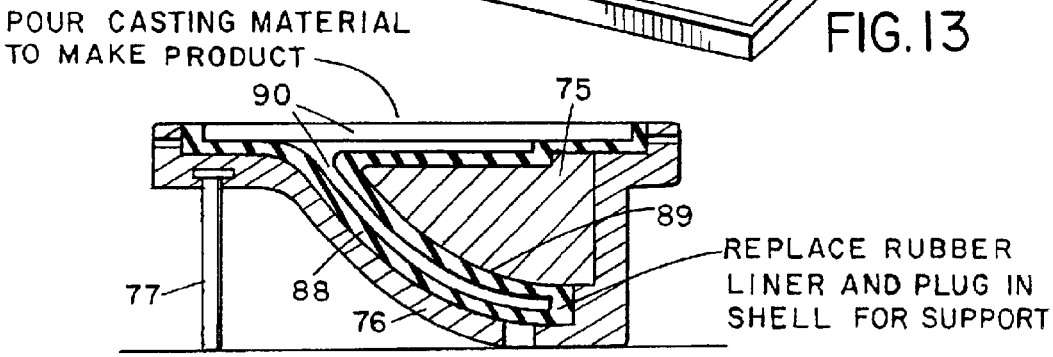
FIG. 14 is a sectional view showing the liner supported for casting.
Figure 15:
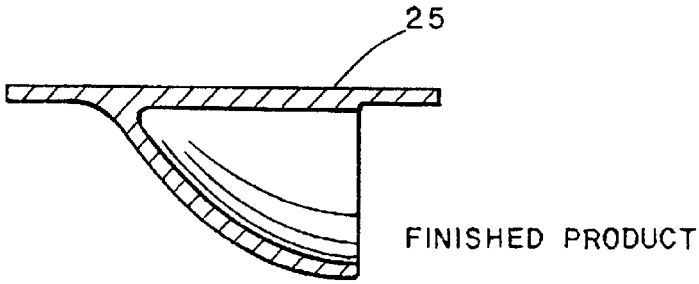
FIG. 15 is a sectional view of the finished product.

The outer shell 76 is then inverted, with the legs 77 supporting it horizontally on a table or the like, a indicated in FIG. 14. The rubber liner 88 is then placed into the shell 76. The plug 75 is placed into the cavity 89 of the liner and supported on the shell 76 so as to hold the liner in the desired position without collapse. A copy of the original model 60 can now be made. Casting material, such as a mixture of Hydrocal or plaster and water, is poured into the mold cavity 90. The mold may be shaken or vibrated to reduce air pockets, and is then left to stand for a predetermined time period while the Hydrocal hardens, typically at least 30 minutes. The finished product 25 is then removed from the mold and air dried for two to three days. The mold can then be re-used to form a plurality of successive sconce panels 25.

Figure 17:
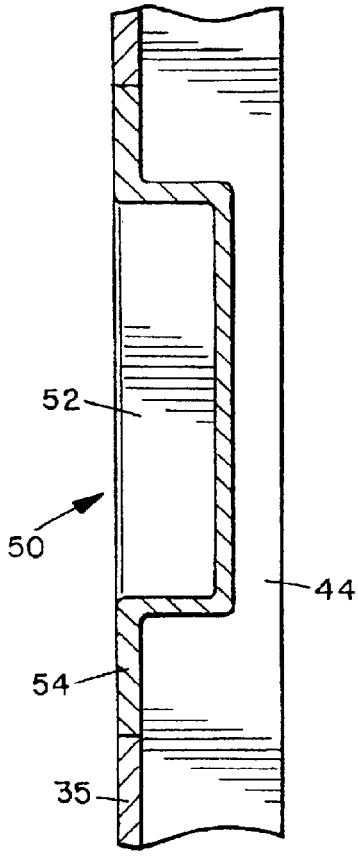

In the embodiment illustrated in FIGS. 2 to 4 and 16, the feature incorporated in the panel 25 is a lighting sconce. However, it will be understood that panels may be provided with other features and mounted in wall or ceiling openings in a similar manner. In each case, the panel dimensions are sufficient to provide a peripheral flange of at least two inches around the entire periphery of the feature, so that the junction between the panel and wall or ceiling opening can be finished to blend into the surrounding opening. FIG. 17 illustrates one alternative panel 50 incorporating a wall niche 52 in which paintings or other decorative items may be mounted. If desired, the niche 52 may be provided with peripheral lighting to light a painting or other item. The niche 52 may be of any desired shape, and has an integral peripheral flange 54 which is secured in the wall opening in the same manner as panel 25.

Figure 18:
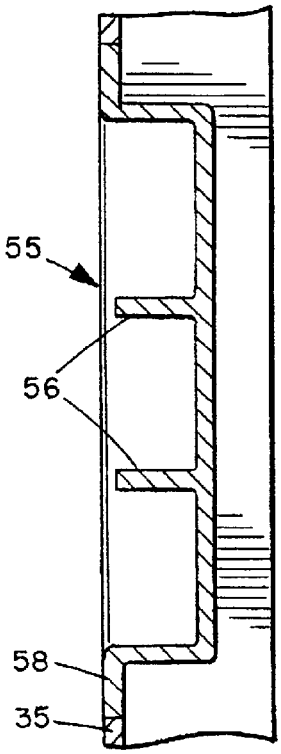
FIG. 18 is a sectional view of an alternative panel incorporating shelves which is mounted in the same manner as the previous embodiments.

FIG. 18 illustrates another alternative panel 55 incorporating recessed shelves 56 and a peripheral flange 58 mounted in a wall opening in the same manner as the previous embodiments. In other alternative examples, a panel may incorporate a bas-relief, sculpture, lighting valance, or the like, so that such features also appear to be integrally formed with the surrounding wall, rather than a separate feature mounted on top of a wall.

Figure 19:
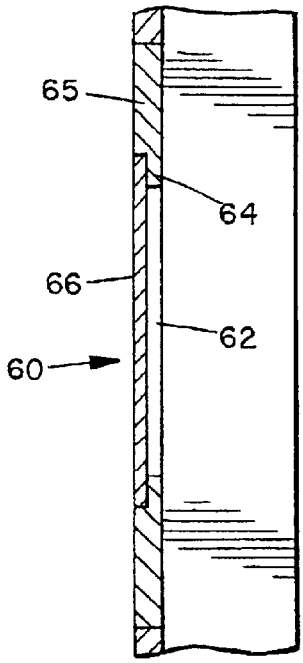
FIG. 19 is a sectional view of an alternative panel with a recess for mounting cover plates, vent covers, access panels and the like, shown mounted in a wall opening with a cover plate installed.

FIG. 19 illustrates a mounting panel 60 with a recessed central area having a central opening 62 and a recessed peripheral rim 64 which may be used for flush mounting of such features as light covers, wall sockets, wall switches, vent covers, and the like. The recessed opening has a flat peripheral flange 65 of predetermined dimensions which is fitted flush in a wall opening as indicated, and finished to appear an integral part of the wall. A conventional cover plate 66 or the like may then be secured in the recessed area and seated against rim 64. Plate 66 can be removably secured to rim 64 with screws or the like, allowing easy access for maintenance or replacement.

Figure 20:
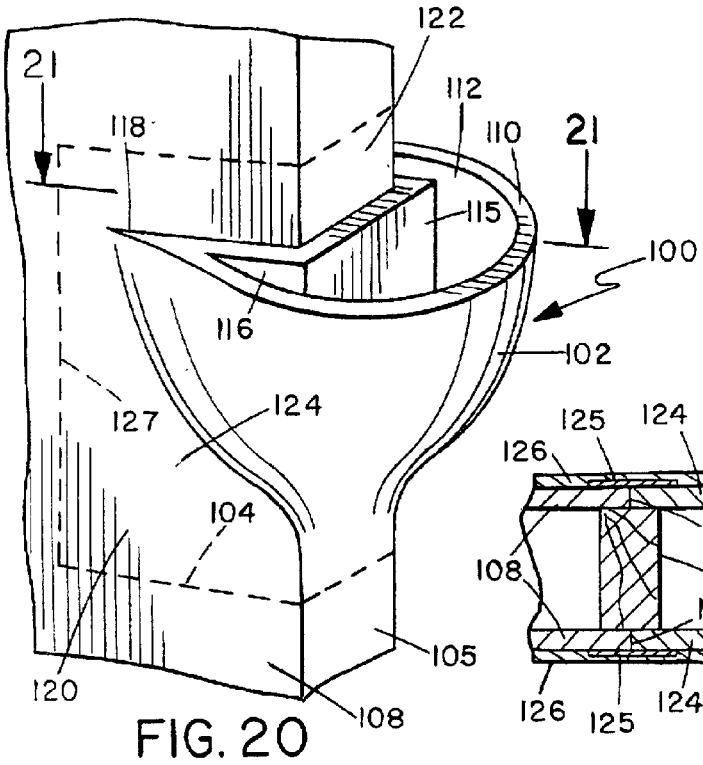
FIG. 20 is a perspective view of a bowl device fitted to the end of a wall.
Figure 21:
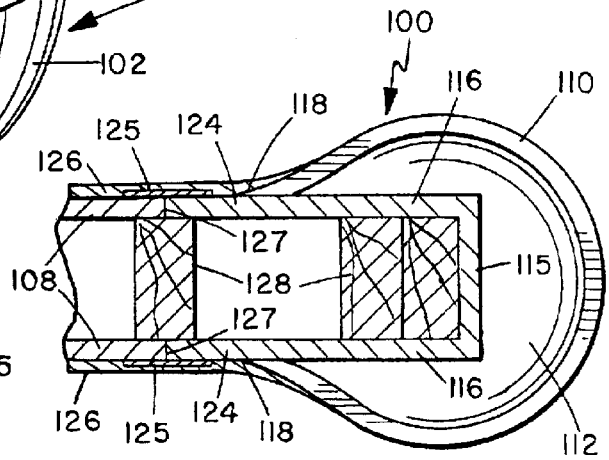
FIG. 21 is a sectional view taken on line 21—21 of FIG. 20.

FIGS. 20 and 21 illustrate another embodiment of a wall structure 100 incorporating a wall mountable device 102 in an opening 104 cut into the end edge 105 of a wall, the wall having opposite wall portions 108 extending from end edge or face 105. The wall mountable device has a bowl shaped body 110 with an upwardly directed opening 112, the body having an outer curved bowl portion and an inner wall having a central flat portion 115 and spaced, rearwardly projecting portions 116 extending perpendicular to flat portion 115 and merging with the bowl portion at the rear perimeter edges 118 on opposite sides of the device. The device has an outer peripheral flange 120 extending outwardly from the periphery of the bowl-shaped body around the entire perimeter of the device, the flange 120 having a flat end portion 122 and rearwardly extending flat portions 124 extending rearwardly from end portion 122.

In order to mount device 102 in the end of a wall, opening 104 of generally rectangular shape is cut into the end portion 105 and opposite wall portions 108 of the wall. The device is then inserted into the opening such that the end portion 122 is flush with wall end edge or face 105 and the rearwardly extending portions 124 are flush with the respective spaced wall portions 108, as indicated in FIG. 21. The flange is then secured to the underlying wall studs 128 in the same manner as described above in connection with FIG. 16. Once the device 102 is secured, drywall tape 125 is applied to cover the seam or dividing line 127 between the perimeter of flange 120 and the edge of opening 104. A coating material 126 such as drywall mud or the like is then applied over the drywall tape, the device 102, and the surrounding wall portions, and the device is finished to match the surrounding wall by painting, texturing, or the like.

The bowl-shaped device 102 may comprise a light sconce or the like, in the same manner as indicated above in FIG. 16, or may be used to hold other decorative items. It will be understood that other decorative items or wall fixtures may be incorporated in such a wall mountable device for securing at the end of a wall in the manner indicated in FIGS. 20 and 21.

Figure 22:
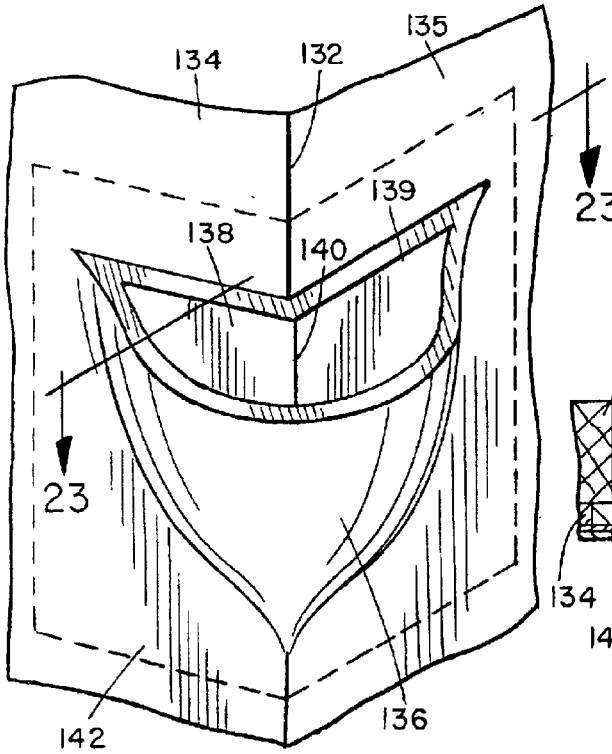
FIG. 22 is a perspective view of a bowl fitted to an outside corner.
Figure 23:
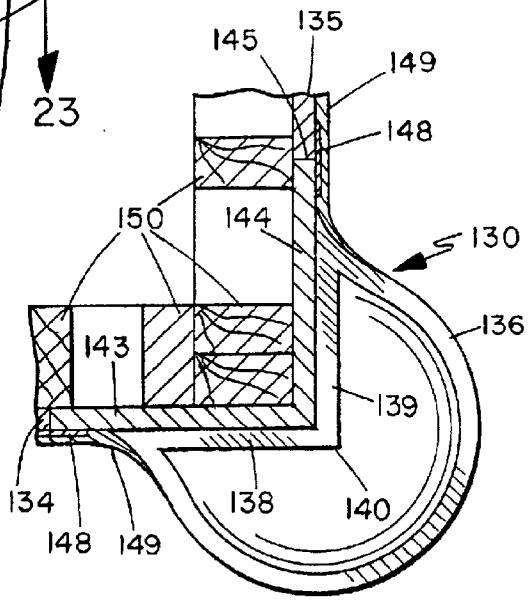
FIG. 23 is a sectional view taken on line 23—23 of FIG. 22.

FIGS. 22 and 23 illustrate another alternative wall mountable device 130 for mounting on an outside corner 132 where two perpendicular walls 134,135 meet. Device 130 has a bowl-shaped body or sconce 136, as in the embodiment of FIGS. 2 to 4, but instead of a flat inner wall, sconce 136 has two inside wall portions 138,139 extending at right angles to form a corner 140 matching the wall corner 132. An outer peripheral flange 142 having perpendicular portions 143,144 projects outwardly around the entire periphery of the bowl-shaped body or sconce 136. Device 130 is mounted in an opening 145 of matching shape and dimensions cut into the wall portions 138,139 across corner 132, with the outer surfaces of flange portions 143,144 flush with the outer surfaces of the corresponding walls 134, 135. The flange is secured to wall studs 150 as in the previous embodiment. The dividing line or seam 146 between the flange 142 and wall opening is concealed by drywall tape 148 and drywall mud, plaster, or other coating material 149 extending over the seam, as in the previous embodiments. Thus, the bowl or sconce device will appear to be an integral part of the surrounding wall structure, enhancing its appearance.

Figure 24:
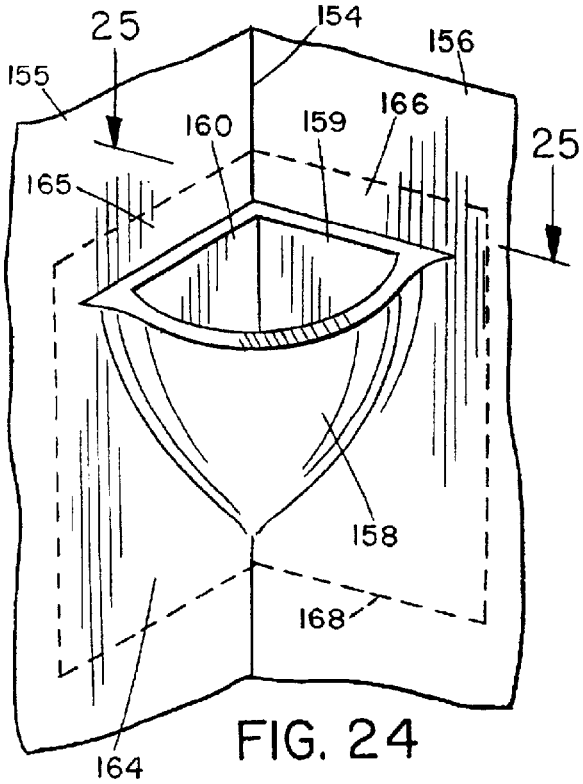
FIG. 24 is a perspective view of a bowl fitted to an inside corner.
Figure 25:
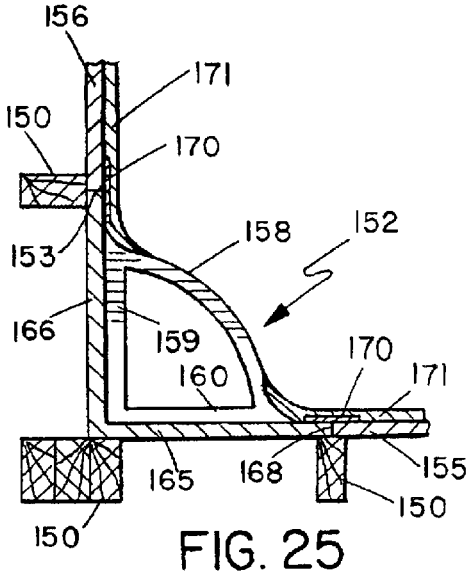
FIG. 25 is a sectional view taken on line 25—25 of FIG. 24.

FIGS. 24 and 25 illustrate a wall mountable device 152 similar to the previous two embodiments for mounting in an opening 153 cut into an inner corner junction 154 between two perpendicular walls 155,156. Device 152 has a bowl-shaped body or sconce 158, as in the embodiment of FIGS. 2 to 4, but instead of a flat inner wall, sconce 158 has two inside wall portions 159,160 extending at right angles to form an internal corner 162 matching the wall corner 154. An outer peripheral flange 164 having perpendicular portions 165,166 projects outwardly around the entire periphery of the bowl-shaped body or sconce 158. Device 152 is mounted in the opening 153 which is of matching shape and dimensions, such that the outer surfaces of flange portions 165,166 are flush with the outer surfaces of the corresponding walls 155, 156. The flange is secured to wall studs 150 as in the previous embodiment. The dividing line or seam 168 between the flange 164 and wall opening is concealed by drywall tape 170 and drywall mud, plaster, or other coating material 171 extending over the seam, as in the previous embodiments. Thus, the bowl or sconce device will appear to be an integral part of the surrounding wall structure, enhancing its appearance.

Figure 27:
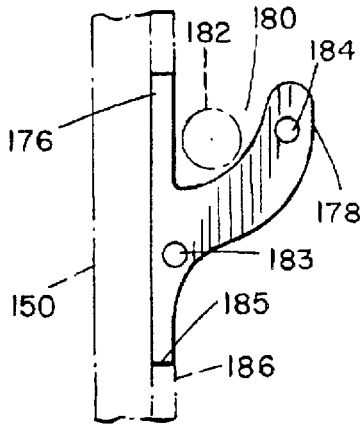
FIG. 27 is an end view of the cove unit with the wall and a light indicated in broken line.
Figure 26:
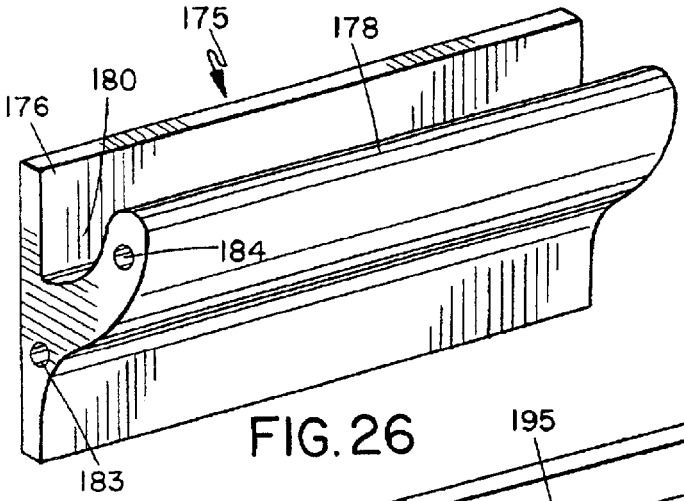
FIG. 26 is a perspective view of a lighting cove unit.

FIG. 26 illustrates another alternative wall mountable device 175 of the same type of material as the previous embodiments, e.g. drywall type material or other material having a surface to which drywall mud or plaster can be applied. In this case, device 175 comprises a valance or cove lighting holder or unit, comprising an elongate or strip-like member having a flat inner wall 176 with an upwardly and outwardly projecting portion 178 of hook-like cross-section, defining a channel 180 for receiving a strip light 182. Device 175 may be made in three or four foot long sections, for example, and may have holes 183,184 at each end for receiving an interlocking device for securing to the end of another, identical device. Thus, the strip lighting holder devices 175 may be secured end to end to run continuously along a wall. The inner wall 176 is mounted in a strip-shaped opening 185 cut into a wall 186, as indicated in FIG. 27, such that the outer face of inner wall 176 is flush with adjacent outer surfaces of wall 186. As in the previous embodiments, the junction between the periphery of wall 176 and the opening will be covered with drywall tape, and then drywall mud or plaster will be applied over the tape and outer surface of device 175 so as to completely conceal the junction.

Figure 28:
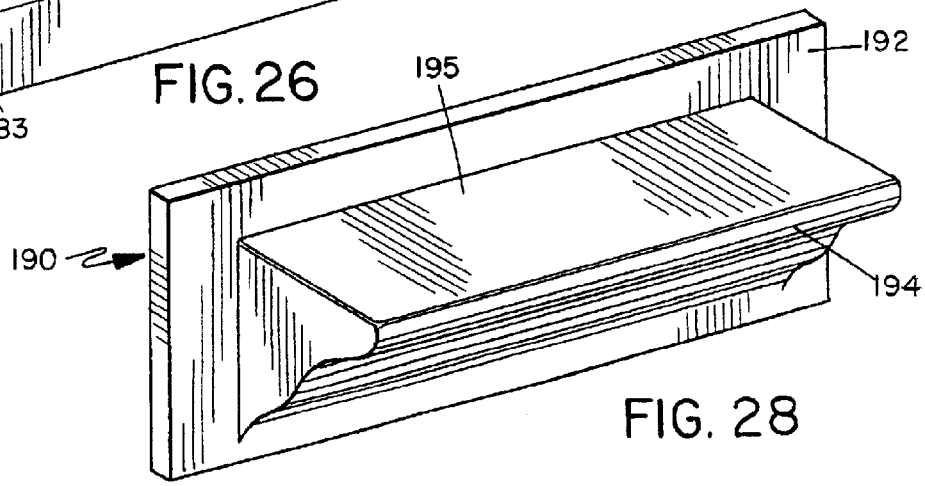
FIG. 28 is a perspective view of a shelf unit.

FIG. 28 illustrates another alternative wall mountable device comprising a shelf unit 190, which is also molded of the same type of material as the previous embodiments, and which is designed for flush mounting in a similar manner in a cut wall opening of appropriate shape and size. Unit 190 has a flat inner wall 192 and an outwardly projecting shelf 194 having a flat upper face 195 for supporting items, with inner wall 192 forming a projecting flange around the entire periphery of shelf 194. If mounted in a wall opening and covered in the manner described above in the previous embodiments, the shelf unit will appear to be an integral part of the wall rather than a separate piece mounted in the wall.

Figure 29:
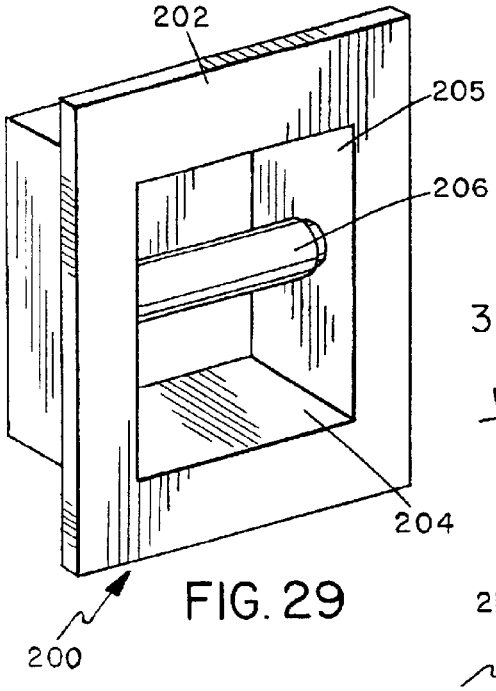
FIG. 29 is a perspective view of a toilet roll holder.

FIG. 29 illustrates another accessory type of wall mountable device for invisible flush mounting in a suitable wall opening. The device of FIG. 29 comprises a toilet paper holder 200 having an outer peripheral flange 202 for flush mounting in a wall opening, and a rectangular or square indented chamber 204 having opposite side walls 205 between which a removable spindle 206 for holding a toilet roll is mounted. The holder 200 will be mounted in a suitably positioned wall opening with flange 202 secured to one or more underlying wall studs and the outer face of the flange flush with the surrounding wall surface. The junction will then be covered by drywall tape, which is then covered by a coating layer of drywall mud or plaster, as in the previous embodiments, concealing the edge of flange 202 and the wall opening. The holder 200 and surrounding wall can then be suitably painted and/or textured, so that the toilet paper holder appears to be an integral part of the wall. This will produce a much smoother and more aesthetically pleasing appearance than current toilet paper holders which are typically screwed on top of a wall and project out from the wall, rather than being recessed.

Figure 30:
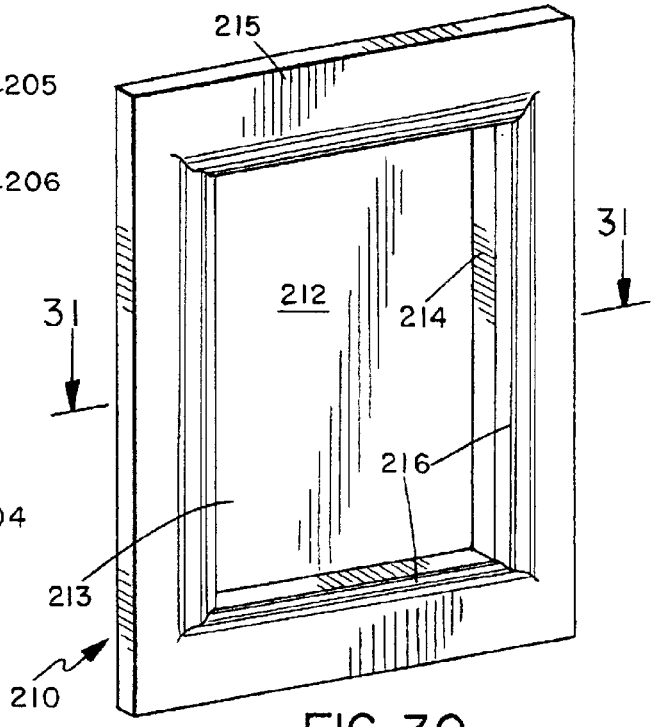
FIG. 30 is a perspective view of a picture frame.
Figure 31:
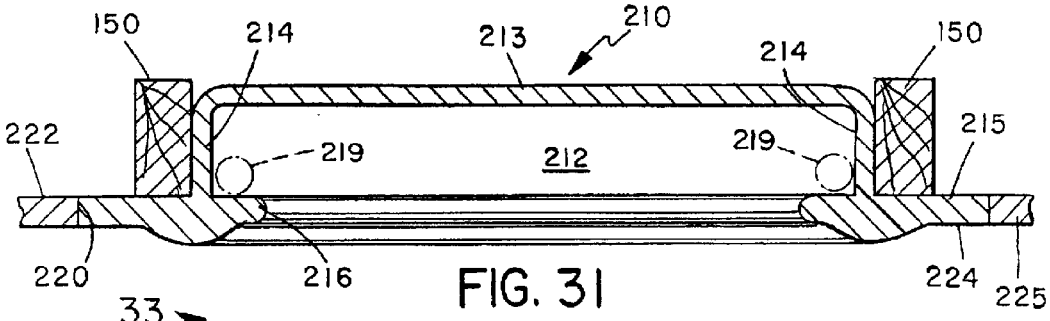
FIG. 31 is an enlarged sectional view taken on line 31–30 of FIG. 30.

FIGS. 30 and 31 illustrate a wall mountable, picture framing niche 210 according to another embodiment of the invention. Again, niche or device 210 will be suitably molded in a material such as drywall type material to which drywall mud or plaster can be applied. Device 210 comprises a generally square or rectangular recess 212 having an inner flat wall 213 and side walls 214, and an outer flat flange 215 extending around the periphery of the recess and having an inwardly projecting rim 216 which projects inwardly from the side walls 214 to hold a painting, picture or the like, and also to form an area 218 for holding a peripheral light 219 or the like for lighting the painting, as indicated in dotted outline in FIG. 31. The niche or device 210 will be mounted in a suitably dimensioned opening 220 cut in a wall 222, securing the flange 215 to underlying wall studs 150 such that the outer surface 224 of the flange is flush with the surrounding wall surface, as indicated in FIG. 31. As in the previous embodiments, the junction 225 between the flange and wall opening will be covered with drywall tape and drywall mud (not illustrated), before finishing the entire assembly to match the surrounding wall finish. Again, this will provide a picture framing niche which appears to have been formed integrally with the wall itself, with no unsightly picture hangers or the like mounted on top of the wall.

Figure 32:
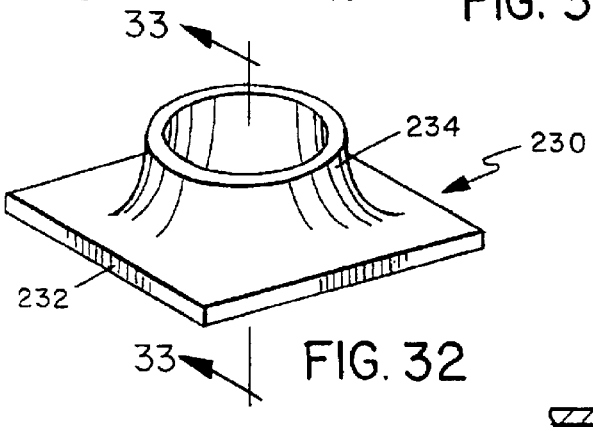
FIG. 32 is a perspective view of a can light unit.
Figure 33:
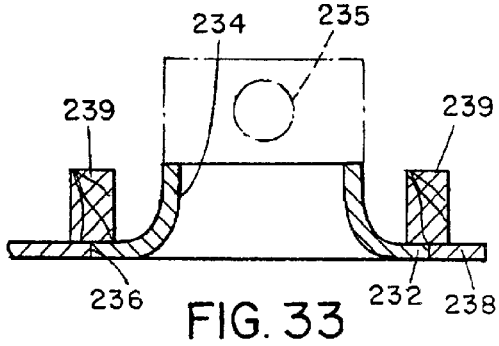
FIG. 33 is a sectional view taken on line 33—33 of FIG. 32, with a can-light indicated in broken line.

Finally, FIGS. 32 and 33 illustrate a can light mounting device 230 according to another embodiment of the invention, for flush mounting in a suitably cut opening in a ceiling. Device 230 will be formed in a suitable material to which drywall mud or plaster can be applied, such as drywall type material. The can light mounting device 230 comprises a generally flat peripheral flange 232 having a rectangular or square outer periphery, and an inwardly projecting, circular rim or trim 234 to which a recessed ceiling can light fixture 235 can be mounted, as indicated schematically in FIG. 33. The device 230 will be suitably positioned in a matching opening 236 in the ceiling 238, and secured to ceiling studs or rafters 239 with the outer surface of flange 232 flush with the surrounding surface of the ceiling, as indicated in FIG. 33. As in the previous embodiments, the junction between device 230 and surrounding ceiling surface will be covered with drywall tape, and the tape will be covered by drywall tape or plaster, before finishing the device and ceiling surface by suitable texturing or painting so that the lighting device appears to be an integral part of the ceiling.

This method allows wall or ceiling features such as light sconces, valances, niches and the like to be pre-manufactured in quantity, making them much less expensive and easier to manufacture. The features will be much more consistent in shape and quality than the previous hand-made features. The same basic method may be used to manufacture panels with features of different shapes, simply by appropriate shaping of the initial model. Thus, sconces and light holders of different shapes and size, valances, niches, shelves and the like may be molded with an integral flange using the same basic technique as described above. This is much faster and significantly less expensive than the typical custom or hand making of wall features. Other decorative wall features such as bas-relief, statues, or the like may be molded with integral peripheral flanges in a similar manner. The feature integrally molded into the panel may be recessed inwardly into the wall, as in the case of the niche and shelving of FIGS. 17 and 18, or may protrude outwardly, as in the case of the sconce or other type of light housing.

The wall or ceiling mounted device and method of this invention has numerous advantages over the prior art. First, the device is fully integrated and flush with the surrounding wall or ceiling, so that it appears to have been formed with the wall itself, rather than a completely separate item stuck on top of the wall. This produces a unique and attractive appearance, without any exposed edges, gaps, or the like between the feature and the wall. Secondly, the feature itself is much more economical to manufacture, and can be mounted in the wall much faster than in the past. In the past, where such features were custom made by hand, then mounted on top of the wall, the process was much slower and inconsistent. With the present invention, installation of the pre-manufactured feature is about 75% faster than custom-building and installation of an equivalent feature in the case of a simple design, and about 200 to 500% faster for more detailed designs, and the feature will be consistent in shape and design.

Although some exemplary embodiments of the invention have been described above by way of example only, it will be understood by those skilled in the field that modifications may be made to the disclosed embodiment without departing from the scope of the invention, which is defined by the appended claims.

I claim:

1. A wall mountable device, comprising:

a body of predetermined shape for forming a wall or ceiling feature, the body having a perimeter and a flat, peripheral flange of predetermined width projecting outwardly from the perimeter of the body, the body being formed of a non-metallic material to which drywall and or plaster can adhere;

the flange having periphery of generally rectangular shape for mounting in a wall or ceiling opening of corresponding shape and dimensions, the flange having an outer face, whereby the flange can be recessed into the wall or ceiling with the outer face of the flange flush with the surrounding wall or ceiling surface, such that the body appears to be molded integrally with the wall or ceiling; and the body comprising a light sconce of generally bowl-like shape having a recess with an upwardly facing opening for receiving a light fitting, the sconce having an inner flat wall and the flange projecting outwardly from the sconce and substantially co-planar with the inner flat wall of the sconce.

2. A wall mountable device, comprising:

a one piece body of predetermined shape for forming a wall feature, the body having a perimeter and a flat, peripheral flange of predetermined width projecting outwardly from the perimeter of the body, the body being formed of a non-metallic material to which drywall and or plaster can adhere; and the flange having periphery of generally rectangular shape for mounting in a wall opening of corresponding shape and dimensions, the flange having an outer face, whereby the flange can be recessed into the wall with the outer face of the flange flush with the surrounding wall surface, such that the body appears to be molded integrally with the wall; and the body comprising a shelving unit having a plurality of shelves and a peripheral wall surrounding the shelves, the flange projecting outwardly from the peripheral wall in a direction perpendicular to the peripheral wall.

3. A wall mountable device, comprising:

a body of predetermined shape for forming a wall or ceiling feature, the body having a perimeter and a flat, peripheral flange of predetermined width projecting outwardly from the perimeter of the body, the body being formed of a non-metallic material to which drywall and or plaster can adhere; and the flange having periphery of generally rectangular shape for mounting in a wall or ceiling opening of corresponding shape and dimensions, the flange having an outer face, whereby the flange can be recessed into the wall or ceiling with the outer face of the flange flush with the surrounding wall or ceiling surface, such that the body appears to be molded integrally with the wall or ceiling; and the body having a central opening and a recessed, flat rim surrounding the opening and recessed inwardly from the outer face of the flange for receiving a wall plate.

4. The device as claimed in claim 3, including a cover plate seated on the flat, recessed rim and extending over the opening, the cover plate being releasably secured to the rim and having an outer face flush with the outer face of the flange.

5. A wall or ceiling structure, comprising:

a portion of a wall or ceiling having an outer surface and an opening of predetermined shape and dimensions through the wall or ceiling portion;

at least one stud behind the opening;

a wall or ceiling mountable device having a body of predetermined shape for forming a wall or ceiling feature, the body having a perimeter and a flat flange projecting outwardly from the perimeter of the body so as to completely surround the body, the flange having a periphery of shape and dimensions matching those of the wall or ceiling opening;

the body comprising a light sconce for projecting outwardly from the wall, the body having a recess with an upwardly facing opening for receiving a light fitting, the sconce having an inner flat wall and the flange projecting outwardly from the sconce and substantially co-planar with the inner flat wall of the sconce;

the device being mounted in the wall or ceiling opening with the periphery of the flange abutting the periphery of the opening to form a dividing seam between the device and wall or ceiling portion, the flange having an outer surface which is flat and substantially flush with the outer surface of the adjacent regions of the wall or ceiling portion;

at least one securing device securing the flange to the stud;

drywall tape applied on top of the dividing seam to cover the seam; and a coating material applied over the outer surface of the device, and over the adjacent wall or ceiling portion and the tape, whereby the device appears to be an integral part of the adjacent wall or ceiling portion with the light sconce projecting outwardly from the wall or ceiling.

6. The structure as claimed in claim 5, wherein the coating material comprises drywall mud.

7. The structure as claimed in claim 5, wherein the portion of a wall or ceiling in which the device is mounted comprises a flat wall portion.

8. The structure as claimed in claim 5, wherein the portion of a wall or ceiling in which the device is mounted comprises a flat portion of a ceiling.

9. The structure as claimed in claim 5, wherein the portion of a wall or ceiling in which the device is mounted comprises an inner corner between two intersecting walls.

10. The structure as claimed in claim 5, wherein there are at least two studs behind the opening and securing devices secure the flange to both studs.

11. The structure as claimed in claim 5, wherein the body has a flat inner wall parallel to the flange and a peripheral rim projecting outwardly from the inner wall.

12. A wall or ceiling structure, comprising:

a portion of a wall or ceiling having an outer surface and an opening of predetermined shape and dimensions through the wall or ceiling portion;

at least one stud behind the opening;

a wall or ceiling mountable device having a body of predetermined shape for forming a wall or ceiling feature, the body having a perimeter and a flat flange projecting outwardly from the perimeter of the body so as to completely surround the body, the flange having a periphery of shape and dimensions matching those of the wall or ceiling opening;

the device being mounted in the wall or ceiling opening with the periphery of the flange abutting the periphery of the opening to form a dividing seam between the device and wall or ceiling portion, the flange having an outer surface which is flat and substantially flush with the outer surface of the adjacent regions of the wall or ceiling portion;

at least one securing device securing the flange to the stud;

drywall tape applied on top of the dividing seam to cover the seam;

a coating material applied over the outer surface of the device, and over the adjacent wall or ceiling portion and the tape, whereby the device appears to be an integral part of the adjacent wall or ceiling portion;

the portion of the wall or ceiling in which the device is mounted comprising an outer corner between intersecting walls.

13. A wall or ceiling structure, comprising:

a portion of a wall or ceiling having an outer surface and an opening of predetermined shape and dimensions through the wall or ceiling portion;

at least one stud behind the opening;

a wall or ceiling mountable device having a body of predetermined shape for forming a wall or ceiling feature, the body having a perimeter and a flat flange projecting outwardly from the perimeter of the body so as to completely surround the body, the flange having a periphery of shape and dimensions matching those of the wall or ceiling opening;

the device being mounted in the wall or ceiling opening with the periphery of the flange abutting the periphery of the opening to form a dividing seam between the device and wall or ceiling portion, the flange having an outer surface which is flat and substantially flush with the outer surface of the adjacent regions of the wall or ceiling portion;

at least one securing device securing the flange to the stud;

drywall tape applied on top of the dividing seam to cover the seam;

a coating material applied over the outer surface of the device, and over the adjacent wall or ceiling portion and the tape, whereby the device appears to be an integral part of the adjacent wall or ceiling portion; and the portion of the wall or ceiling in which the device is mounted comprising an end of a wall.

14. A wall or ceiling structure, comprising:

a portion of a wall or ceiling having an outer surface and an opening of predetermined shape and dimensions through the wall or ceiling portion;

at least one stud behind the opening;

a wall or ceiling mountable device having a body of predetermined shape for forming a wall or ceiling feature, the body having a perimeter and a flat flange projecting outwardly from the perimeter of the body so as to completely surround the body, the flange having a periphery of shape and dimensions matching those of the wall or ceiling opening;

the device being mounted in the wall or ceiling opening with the periphery of the flange abutting the periphery of the opening to form a dividing seam between the device and wall or ceiling portion, the flange having an outer surface which is flat and substantially flush with the outer surface of the adjacent regions of the wall or ceiling portion;

at least one securing device securing the flange to the stud;

drywall tape applied on top of the dividing seam to cover the seam;

a coating material applied over the outer surface of the device, and over the adjacent wall or ceiling portion and the tape, whereby the device appears to be an integral part of the adjacent wall or ceiling portion; and the body is generally bowl-shaped and has an upwardly directed opening for receiving a light fixture, and the flange projects outwardly around the periphery of the bowl-shaped body.

15. The structure as claimed in claim 14, wherein the body has a flat inner wall.

16. The structure as claimed in claim 14, wherein the bowl has an outer arcuate portion and two perpendicular inner wall sections forming a perpendicular junction, and the flange has corresponding perpendicular portions projecting outwardly, the portion of a wall comprising adjacent sections of two perpendicular walls at a corner between the walls, and the opening being cut in said perpendicular walls across said corner.

17. A wall or ceiling structure, comprising:

a portion of a wall or ceiling having an outer surface and an opening of predetermined shape and dimensions through the wall or ceiling portion;

at least one stud behind the opening;

a wall or ceiling mountable device having a body of predetermined shape for forming a wall or ceiling feature, the body having a perimeter and a flat flange projecting outwardly from the perimeter of the body so as to completely surround the body, the flange having a periphery of shape and dimensions matching those of the wall or ceiling opening;

the device being mounted in the wall or ceiling opening with the periphery of the flange abutting the periphery of the opening to form a dividing seam between the device and wall or ceiling portion, the flange having an outer surface which is flat and substantially flush with the outer surface of the adjacent regions of the wall or ceiling portion;

at least one securing device securing the flange to the stud;

drywall tape on top of the dividing seam to cover the seam;

a coating material applied over the outer surface of the device, and over the adjacent wall or ceiling portion and the tape, whereby the device appears to be an integral part of the adjacent wall or ceiling portion; and the wall mountable device comprising a recessed picture mounting niche.

18. A wall or ceiling structure, comprising:

a portion of a wall or ceiling having an outer surface and an opening of predetermined shape and dimensions through the wall or ceiling portion;

at least one stud behind the opening;

a body of predetermined shape for forming a wall feature, the body having a main body portion having a perimeter and a flat, peripheral flange of predetermined width and rectangular shape and dimensions corresponding to the shape and dimensions of the wall opening, the flange projecting outwardly from the perimeter of the main body portion, the main body portion and the flange being integrally molded, and the body being formed of a non-metallic material to which drywall and or plaster can adhere;

the body being mounted in the wall or ceiling opening with the periphery of the flange abutting the periphery of the opening, the flange having an outer face flush with the surrounding wall surface, such that the body appears to be molded integrally with the wall; and the main body portion having a flat inner wall parallel to the flange and a peripheral frame surrounding the inner wall and projecting outwardly from the inner wall to the flange, the peripheral frame having an inner face.

19. The device as claimed in claim 18, including a light fixture mounted on the inner face of the frame.

20. The device as claimed in claim 18, wherein the peripheral frame includes a horizontal support ledge for supporting one or more items.

21. The device as claimed in claim 18, wherein the flange has a width of at least two inches around the entire perimeter of the body.

22. A wall mountable device, comprising:

a body of predetermined shape for forming a wall or ceiling feature, the body having a perimeter and a flat, peripheral flange of predetermined width projecting outwardly from the perimeter of the body, the body being formed of a non-metallic material to which drywall or plaster can adhere;

the flange having a periphery of generally rectangular shape for mounting in a wall or ceiling opening of corresponding shape and dimensions, whereby the flange can be recessed into the wall or ceiling with the outer face of the flange flush with the surrounding wall or ceiling surface, such that the body appears to be molded integrally with the wall or ceiling; and the body comprising a light sconce for projecting outwardly from the wall, the body having a recess with an upwardly facing opening for receiving a light fitting, the sconce having an inner flat wall and the flange projecting outwardly from the sconce and substantially co-planar with the inner flat wall of the sconce.

* * * * *